US006910402B2

(12) United States Patent
Drzewiecki

(10) Patent No.: US 6,910,402 B2
(45) Date of Patent: Jun. 28, 2005

(54) PIPE SPINNER

(75) Inventor: Lopek Drzewiecki, Edmonton (CA)

(73) Assignee: National-Oilwell, L. P., Houston, TX (US)

( * ) Notice: Subject to any disclaimer, the term of this patent is extended or adjusted under 35 U.S.C. 154(b) by 0 days.

(21) Appl. No.: 10/640,531

(22) Filed: Aug. 13, 2003

(65) Prior Publication Data

US 2005/0034565 A1 Feb. 17, 2005

(51) Int. Cl.[7] ..... B25B 13/50

(52) U.S. Cl. ..... 81/57.17; 81/57.19; 81/57.2; 81/57.34

(58) Field of Search ..... 81/57.15, 57.17, 81/57.19, 57.2, 57.33, 57.34, 57.43

(56) References Cited

U.S. PATENT DOCUMENTS

| | | | | |
|---|---|---|---|---|
| 1,760,167 A | | 5/1930 | Palmer | |
| 1,925,970 A | | 9/1933 | Pennington | |
| 2,523,159 A | | 9/1950 | Stone | |
| 2,746,329 A | | 5/1956 | Pagel | |
| 2,784,626 A | | 3/1957 | Paget | |
| 2,928,301 A | | 3/1960 | Beeman et al. | |
| 3,799,010 A | | 3/1974 | Guier | |
| 3,906,820 A | | 9/1975 | Hauk | |
| 4,079,640 A | | 3/1978 | Golden | |
| 4,099,429 A | | 7/1978 | Hauk | |
| 4,212,212 A | | 7/1980 | Chandler et al. | |
| 4,324,157 A | | 4/1982 | Soutsos | |
| 4,471,674 A | | 9/1984 | Doss | |
| 4,494,424 A | | 1/1985 | Bates | |
| 4,512,216 A | | 4/1985 | Callegari, Sr. et al. | |
| 4,604,922 A | | 8/1986 | Soutsos | |
| 4,694,712 A | | 9/1987 | Doss | |
| 4,843,924 A | | 7/1989 | Hauk | |
| 4,895,056 A | * | 1/1990 | Schulze-Beckinghausen | 81/57.17 |
| 5,054,550 A | | 10/1991 | Hodge | |

* cited by examiner

*Primary Examiner*—Debra S Meislin
(74) *Attorney, Agent, or Firm*—Conley Rose, P.C.

(57) ABSTRACT

Methods and apparatus for spinning a pipe using a flexible belt. The spinner utilizes a single actuation mechanism contained within a rigid body to engage the pipe and tension the belt. The pipe is engaged by one or more pivoting arms that are locked into place by pins attached to the actuation mechanism interfacing with slots in the pivoting arm and spinner body. Once the arms are locked in place, the belt is tensioned and can be driven to rotate the pipe. The single actuation mechanism is preferably embodied by a linear actuator connected between a pivoting arm and a moveable motor. The pivoting arm is spring biased so that the arm pivots before the motor is moved. The spinner may use two pivoting arms, or one pivoting arm and one stationary arm.

17 Claims, 3 Drawing Sheets

PIPE SPINNER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to methods and apparatus for rotating tubular members, such as drill pipe. More particularly, the present invention relates to methods and apparatus for spinning a drill pipe during connection and disconnection of the drill pipe in a drill string.

In rotary drilling applications, a tubular drill string is formed from a series of connected lengths of drill pipe. The individual lengths of drill pipe are joined by threaded connections. During the drilling and completion of a well, the drill string must occasionally be pulled from the well and reinstalled. The process of pulling or installing the drill string is referred to as "tripping." During tripping, the threaded connections between the lengths of drill pipe are connected and disconnected as needed. The connecting and disconnecting of adjacent sections of drill pipe (referred to as making or breaking the connection, respectively), involves applying torque to the connection and rotating one of the pipes to fully engage or disengage the threads.

In modern wells, a drill string may be thousands of feet long and typically is formed from individual thirty foot sections of drill pipe. Even if only every third connection is broken, as is common, hundreds of connections have to be made and broken during tripping. Thus, it can be seen that the tripping process is one of the most time consuming and labor intensive operations performed on the drilling rig.

Currently, there are a number of devices that seek to speed tripping operations by automating or mechanizing the process of making and breaking a threaded pipe connection. These devices include tools known as power tongs, iron roughnecks, and pipe spinners. Many of these devices are complex pieces of machinery that require two or more people to operate and require multiple steps, either automated or manual, to perform the desired operations. Additionally, many of these devices grip the pipe with teeth that can damage the drill pipe and often cannot be adjusted to different pipe diameters without first replacing certain pieces, or performing complex adjustment procedures.

Thus, the embodiments described herein are directed to methods and apparatus for gripping and spinning a pipe for making or breaking a connection that seek to overcome these or various other limitations of the prior art.

SUMMARY OF THE PREFERRED EMBODIMENTS

The preferred embodiments include methods and apparatus for spinning a pipe using a flexible belt. The spinner utilizes a single actuation mechanism to engage the pipe and tension the belt. The pipe is engaged by one or more pivoting arms that are locked into place by pins attached to the actuation mechanism and interfacing with slots in the pivoting arm and spinner body. Once the arms are locked in place, the belt is tensioned and can be driven by a motor to rotate the pipe. The single actuation mechanism is preferably embodied by a linear actuator connected between a pivoting arm and a moveable motor. The pivoting arm is spring biased so that the arm pivots and locks into place before the motor is moved. The spinner may use two pivoting arms, or one pivoting arm and one stationary arm.

In one embodiment, the spinner includes a pair of pivoting arms supported on a rigid body. In this embodiment, a flexible belt is wound around a rotating drive motor and around rollers attached to each arm. The drive motor is slidably mounted to the body. Linear actuators, such as hydraulic cylinders, connect the pivoting arms to the drive motor. As the actuators extend, a spring biases the arms toward a closed position such that the arms close around a pipe before the motor begins to slide and apply tension to the belt. Slots on the arms and the body interface with a pin on the end of the cylinders to prevent the arms from opening when the actuators are extended.

In another embodiment, the pipe spinner comprises a body, an arm pivotally connected to the body and adapted to engage a pipe with a flexible belt, a drive assembly moveably connected to the body and adapted to engage the flexible belt, and a linear actuator connected to the arm and the drive assembly, wherein the linear actuator is adapted to move the arm to engage the pipe and move the drive assembly to apply tension to the flexible belt. The spinner may also include a locking mechanism adapted to maintain the engagement of the arm and the pipe, where the locking mechanism is actuated by the linear actuator and may include a first slot on the arm, which is adapted to guide a pin attached to one end of the linear actuator, and a second slot on the body, which is adapted to guide the pin. In certain embodiments, the body encloses the pivoting arm, the drive assembly, and the linear actuator. The pipe spinner may also include a pin connecting one end of the linear actuator to the motor assembly, wherein the pin is adapted to slide within a slot on the body, and a spring adapted to urge the pivoting arm to an engaged position with the pipe.

In an alternate embodiment, a device for rotating a tubular member comprises a body and a pivoting arm connected to the body and having a closed position engaging the tubular with a flexible belt and an open position not engaging the tubular. A moveable drive assembly is connected to the body and has a first position not applying tension the flexible belt and a second position applying tension to the flexible belt. A linear actuator is adapted to move the pivoting arm from the open position to the closed position and the moveable drive from the first position to the second position, wherein the moveable drive is moved to the second position after the pivoting arm is moved to the closed position.

Another embodiment includes a method for operating a pipe spinner comprising pivoting an arm to surround a pipe with a flexible belt, moving a drive assembly to apply tension to the flexible belt, and activating the drive assembly to drive the belt and rotate the pipe, wherein the arm is pivoted and the drive assembly is moved by a single linear actuator. The method may also include engaging a locking mechanism to maintain the position of the arm, wherein the locking mechanism is engaged by the single linear actuator. In alternative methods, a spring may urge the arm to surround the pipe and the pipe spinner comprises two pivoting arms and two linear actuators.

Thus, the present invention comprises a combination of features and advantages that enable it to substantially improve the gripping an spinning of a tubular member. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the present invention, reference is made to the accompanying Figures, wherein.

DETAILED DESCRIPTION OF THE PREFERRED EMBODIMENTS

Figure 1:
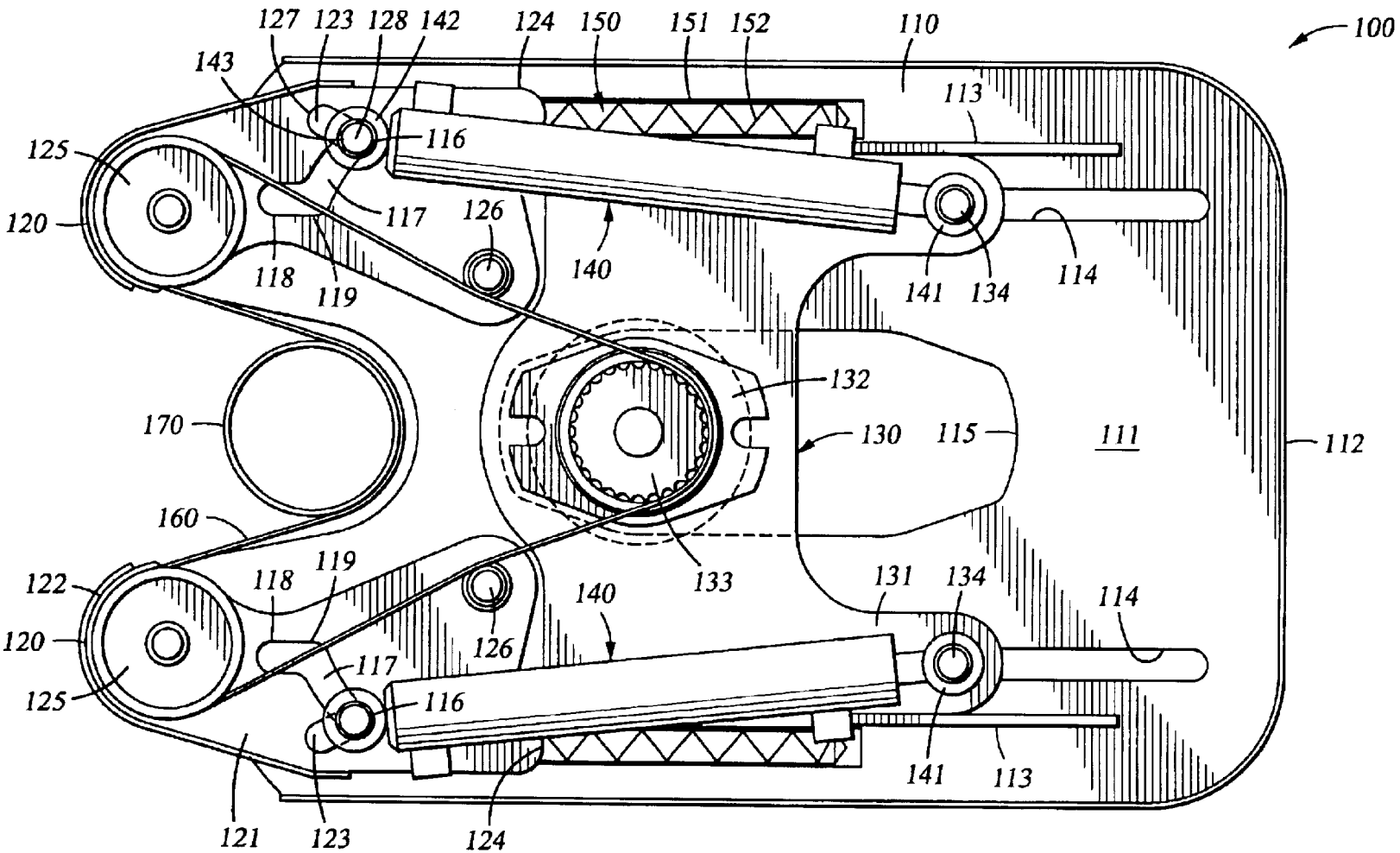
FIG. 1 is a schematic view of one embodiment of a dual armed pipe spinner shown in the open position.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

The preferred embodiments of the present invention relate to methods and apparatus for rotating a tubular member, such as a pipe. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. In particular, various embodiments of the present invention provide a number of different spinner configurations. Reference is made to the application of the concepts of the present invention to rotating drill pipe, but the use of the concepts of the present invention is not limited to these applications, and can be used for any other applications including the rotation of cylindrical bodies and in particular to the manipulation of other members having threaded connections. It is to be fully recognized that the different teachings of the embodiments discussed below may be employed separately or in any suitable combination to produce desired results.

Referring now to FIG. 1, spinner assembly 100 includes body 110 supporting two pivoting arms 120, slidable motor assembly 130, linear actuators 140, bias members 150, and flexible belt 160. The structure of spinner assembly 100 is essentially mirrored about its longitudinal centerline. Body 110 includes a substantially flat base 111 having walls 112 substantially surrounding three sides of body 110. Base 111 includes vertical guide walls 113, linear slots 114, motor slot 115, locking slots 116, and mounts for pivots 126. Locking slots 116 have a curved portion 117, which has an axis of curvature located at pivot 126, and a straight portion 118 substantially parallel to linear slots 114. Curved portion 117 and straight portion 118 intersect at transition point 119. Body 110 also preferably includes a top portion (not shown) which has similar features to base 111 and is mounted to walls 112, forming a substantially enclosed apparatus.

Pivoting arms 120 attach to body 110 at pivot 126. Arms 120 include a substantially flat base 121 having a guard wall 122, slot 123, and protruding end portion 124. Idler rollers 125 attach to base 121 and are free to rotate relative thereto. Slot 123 has a forward end 127 and a rearward end 128.

Motor assembly 130 includes sliding plate 131 that supports motor 132. Motor 132 is preferably a hydraulic or air motor that drives belt sprocket (pulley) 133. Motor assembly 130 is supported in a slidable relationship with body 110 and is aligned with motor slot 115. Sliding plate 131 also includes attachment points for pins 134 that move within linear slots 114.

Two linear actuators 140, which may preferably be hydraulic cylinders, include a rod end 141 and barrel end 142. Rod end 141 accepts rod end pin 134, which slides in linear slot 114. Barrel end 142 accepts pin 143, which slides in locking slot 116 and arm slot 123. It is understood that actuators 140 may also be reversed where the rod end and barrel end are opposite as shown and described.

Bias members 150 include spring barrels 151 containing springs 152 that tend to bias arms 120 toward a closed position. Springs 152 exert a force on the protruding end 124 of the arms 120. This force acts against body 110 and tends to pivot arms 120 about pivot 126 toward the closed position. The force exerted by springs 152 can be overpowered by the force applied by actuators 140.

A flexible, flat belt 160, runs over motor sprocket 133, idler rollers 125, and around pipe 170. Belt 160 is preferably constructed from a flexible, strong material such as KEVLAR®, or some other durable, high strength, woven, composite material. In the preferred embodiments, belt 160 grips pipe 170 without damaging the outer surface of the pipe and provides sufficient friction to rotate the pipe as desired.

Pivoting arms 120 are pivotally attached to body 110 by pivot connections 126. Motor assembly 130 is adapted to slide back and forth inside the body 110 where its motion is guided by walls 113 and is limited by rod end pins 134 sliding in linear slots 114. The rod end pins 134 attach to the rod ends 141 of linear actuators 140. The barrel ends 142 of linear actuators 140 are attached to body 110 and pivoting arms 120 by barrel end pins 143 interfacing with locking slots 116 and arm slots 123.

Figure 2:
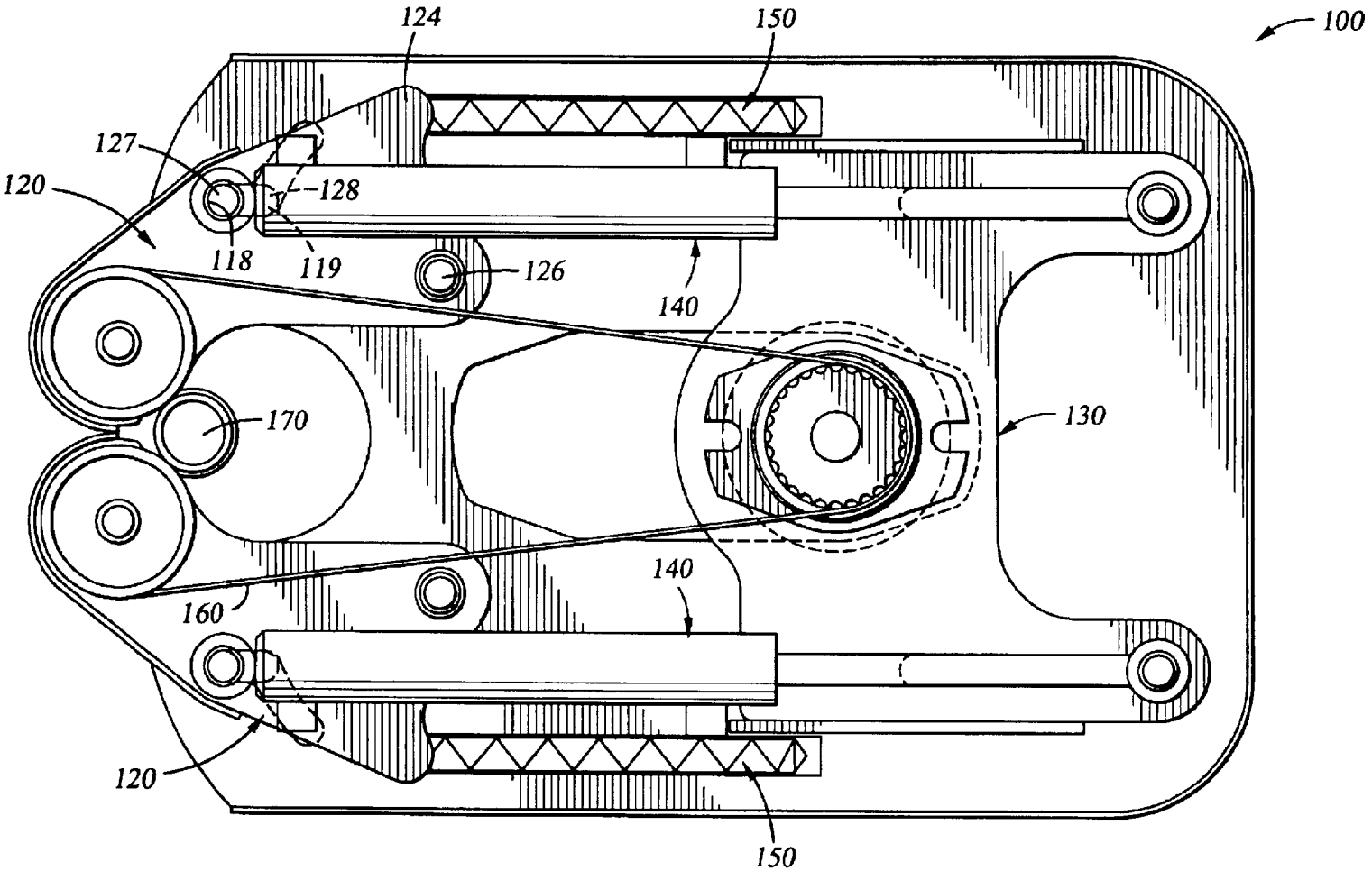
FIG. 2 is a schematic view of the spinner of FIG. 1 shown in a closed position.

In FIG. 1, spinner 100 is shown in the open position with arms 120 fully opened, springs 152 compressed, linear actuators 140 fully retracted, motor assembly 130 in a forward position, and belt 160 fully relaxed and in a position ready to wrap around the pipe 170. FIG. 2 shows spinner 100 in a closed position with arms 120 closed, springs 152 extended, linear actuators 140 extended, motor assembly 130 in a rearward position, belt 160 wrapped around pipe 170 and in tension ready to spin the pipe. In this closed position, motor 132 rotates sprocket 133, which transfers motion through belt 160 to rotate pipe 170.

In order for the spinner to move from the open position shown in FIG. 1 to the closed position shown in FIG. 2, a valve (not shown) controlling the supply of fluid to linear actuators 140 is switched to start the extension of the cylinders. At this point (the open position) the rod ends 141 of the actuators 140 with rod end pins 134 are in the forward ends of linear slots 114 and the barrel ends 142 with barrel end pins 143 are in the outside end of the curved portion 117 of locking slots 116 and in the rearward end 128 of arm slots 123.

As actuators 140 start to extend, bias members 150 push arm end portions 124 causing the rotation of arms 120 about pivots 126. This motion rotates actuators 140 about rod end pins 134 and moves barrel end pins 143 through curved portion 117 of locking slot 116 towards transition point 119. Idler rollers 125 move toward each other as arms 120 rotate toward the closed position. As barrel end pins 143 reach transition point 119, arm slots 123 align with straight portions 118 of locking slots 116 and are substantially in line with linear slots 114.

From this intermediate position, further extension of actuators 140 move barrel end pins 143 through the straight portions 118 of locking slots 116 and from the rearward end 128 to the forward end 127 of arm slot 123. Once barrel end pins 143 reach the forward end 127 of arm slot 123, arms 120 are essentially locked in place until actuators 140 are retracted. The forces on arms 120 from belt tensioning and operation of the apparatus will tend to pivot the arms toward the open position, but these forces are resisted by barrel end pins 143 being retained by the straight portion 118 of locking slot 116.

Rod end pins 134 move toward the rearward end of linear slots 114, moving motor assembly 130 rearward and tightening belt 160 around pipe 170. Belt 160 can tighten around any diameter pipe that can be engaged by arms 120. No input or adjustment from the operator is required.

Once fully in the closed position shown in FIG. 2, motor 132 can be actuated so as to rotate sprocket 133, which moves belt 160 that rotates pipe 170. Locking slots 116 and arm slots 123 constrain barrel end pins 143 to operate as a safety lock preventing arms 120 from opening as pipe 160 is pushed by belt 170 against rollers 125. Once arms 120 are locked in the fully closed position, they can only open after barrel end pins 143 are retracted by linear actuators 140.

Returning spinner assembly 110 to the open position from the closed position, which releases pipe 170, operates in the opposite sequence. As actuators 140 start retracting, bias members 150 maintain arms 120 in the closed position until rod ends 141 with rod end pins 134 reach the forward ends of linear slots 114. At this point, motor assembly 130, including with motor 132 and sprocket 133, is in a forward position where belt 160 is loose.

Further retraction of actuators 140 moves barrel ends 142 and barrel end pins 143 through transition point 119 and into curved portion 117 of locking slots 116. Arms 120 rotate about pivot 126 to their open position and collapse springs 151 into their barrels 152. Once arms 120 fully open, pipe 160 is released and spinner 100 is ready for a new operation.

The unique actuation sequence, which closes and locks the pipe in place before tensioning the belt allows the device to handle a wide range of pipe sizes with one belt length and without any additional adjustment by the operator. The arrangement of the slots provide a self-locking feature that eliminates certain complexities found in other belt-type spinners that include a separately engaging lock feature to retain the pipe in the spinner.

Figure 3:
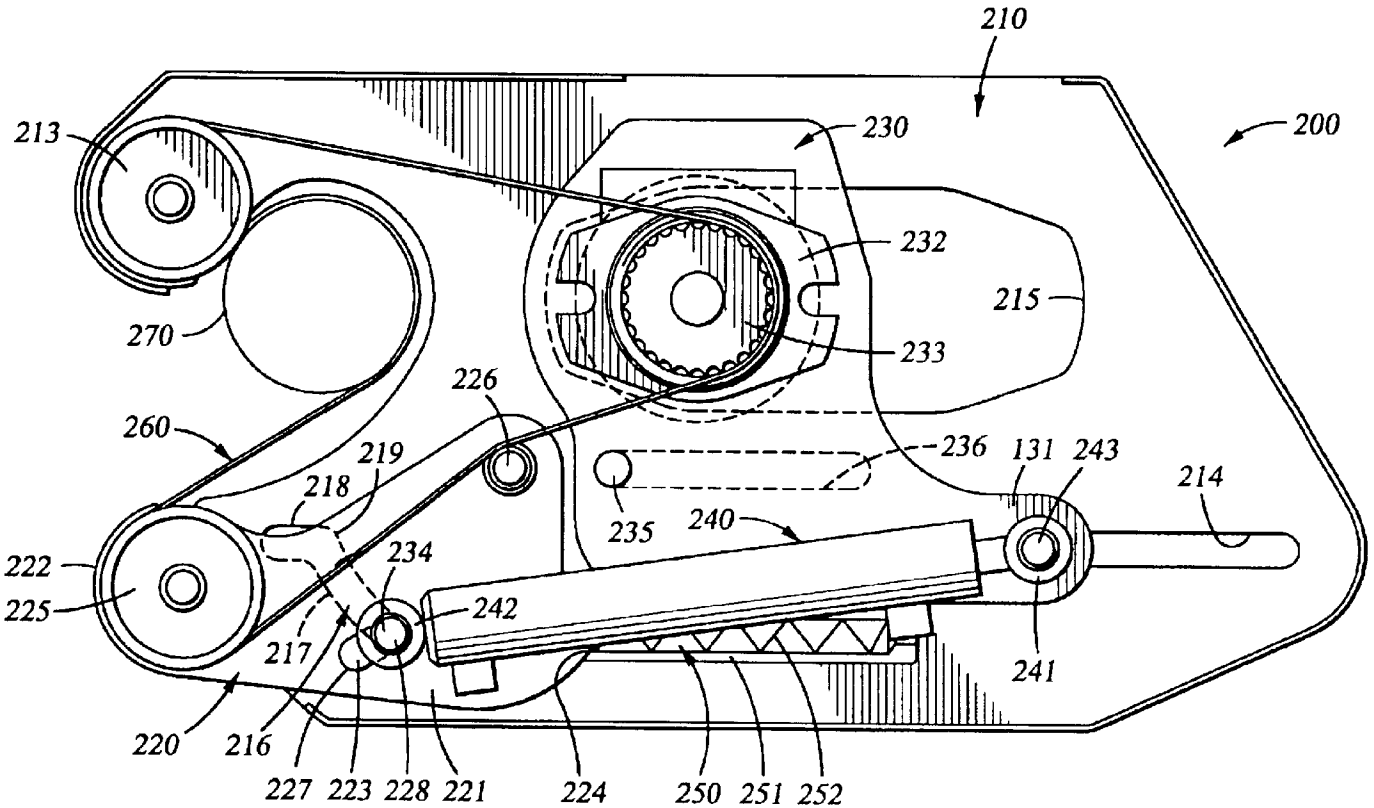
FIG. 3 is a schematic view of another embodiment having a single armed pipe spinner shown in the open position.

Referring now to FIG. 3, an alternative spinner assembly 200 is shown having only one pivoting arm 220 mounted to a rigid body 210. This simplified device is especially suitable for spinning tubular members that are oriented in a horizontal position, such as would be found in shop conditions, but is also equally adaptable for use on vertically oriented tubular members.

Spinner assembly 200 includes body 210 supporting one pivoting arm 220, a slidable motor assembly 230, a linear actuator 240, a bias member 250, and a flexible belt 260. Body 210 includes a substantially flat base 211 having walls 212 substantially surrounding three sides of body 210. A single idler puller 213 is mounted to base 211 and acts as a stationary arm. Base 211 also includes linear slots 214 and 236, motor slot 215, locking slot 216, and a mount for pivot 226. Locking slot 216 has a curved portion 217 with a axis of curvature located at pivot 226 and a straight portion 218 substantially parallel to linear slots 214. Curved portion 217 and straight portion 218 intersect at transition point 219. Body 210 also preferably includes a top portion (not shown) which has similar features to base 211 and is mounted to walls 212, forming a substantially enclosed apparatus.

Pivoting arms 220 attach to body 210 at pivot 226. Arms 220 include a substantially flat base 221 having a guard wall 222, slot 223, and protruding end portion 224. Idler roller 225 attaches to base 221 and is free to rotate relative thereto. Slot 223 has a forward end 227 and a rearward end 228.

Motor assembly 230 includes sliding plate 231 that supports motor 232. Motor 232 is preferably a hydraulic or air motor that drives belt sprocket (pulley) 233. Motor assembly 230 is supported in a slidable relationship with body 210 and is aligned with motor slot 215. Sliding plate 231 also includes guide pin 235, which interfaces with linear slot 236, and an attachment point for rod end pin 234 that move within linear slot 214.

Linear actuator 240, which may preferably be a hydraulic cylinder, includes a rod end 241 and barrel end 242. Rod end 241 accepts rod end pin 234, which slides in linear slot 214. Barrel end 242 accepts pin 243, which slides in locking slot 216 and arm slot 223. It is understood that actuator 240 may also be reversed where the rod end and barrel end are opposite as shown and described.

Bias member 250 includes spring barrel 151 containing spring 152 that tends to bias arm 220 toward a closed position. Spring 252 exerts a force on the protruding end 224 of arm 220. This force acts against body 210 and tends to pivot arm 220 about pivot 226 toward the closed position. The force exerted by spring 252 can be overpowered by the force applied by actuator 240.

A flexible, flat belt 260, runs over motor sprocket 233, idler rollers 213 and 225, and around pipe 270. Belt 260 is preferably constructed from a flexible, strong material such as KEVLAR®, or some other durable, high strength, woven, composite material. In the preferred embodiments, belt 260 grips pipe 270 without damaging the outer surface of the pipe and provides sufficient friction to rotate the pipe as desired.

Pivoting arm 220 is pivotally attached to body 210 by pivot connection 226. Motor assembly 230 is adapted to slide back and forth inside the body 210, where its motion is guided and limited by guide pin 235 in linear slot 235 and rod end pin 134 in linear slot 214. The rod end pin 234 attaches to the rod end 241 of linear actuator 240. The barrel end 242 of linear actuator 240 are attached to body 210 and pivoting arm 220 by barrel end pin 243 interfacing with locking slot 216 and arm slot 223.

In FIG. 3, spinner 200 is shown in the open position with arm 220 fully opened, spring 252 compressed, linear actuator 240 fully retracted, motor assembly 230 in a forward position, and belt 260 fully relaxed and in a position ready to wrap around the pipe 270. In the open position the rod end 241 of the actuator 240 is in the forward end of linear slot 214 and the barrel end 242 is in the outside end of the curved portion 217 of locking slot 216 and in the rearward end 228 of arm slot 223. Linear actuator 240 is extended to move spinner 200 from the open position shown in FIG. 3 to a closed position. Spinner 200 operates in the same manner as spinner 100 of FIG. 1 and FIG. 2.

As actuator 240 starts to extend, bias member 250 pushes arm end portion 224 causing the rotation of arms 220 about pivot 226. This motion rotates actuator 240 about rod end pin 234 and moves barrel end pin 243 through curved portion 217 of locking slot 216 towards transition point 219.

Idler roller 225 moves toward idler roller 213 as arm 220 rotates toward the closed position. As barrel end pin 243 reaches transition point 219, arm slot 223 aligns with straight portion 218 of locking slot 216 and is substantially in line with linear slot 214.

From this intermediate position, further extension of actuator 240 moves barrel end pin 243 through the straight portions 218 of locking slot 216 and from the rearward end 228 to the forward end 227 of arm slot 223. Once barrel end pin 243 reaches the forward end 227 of arm slot 223, arm 220 is essentially locked in place until actuator 240 is retracted. The forces on arm 220 from belt tensioning and operation of the apparatus will tend to pivot the arm toward the open position, but these forces are resisted by barrel end pin 243 being retained by the straight portion 218 of locking slot 216.

Rod end pin 234 moves toward the rearward end of linear slot 214, moving motor assembly 230 rearward and tightening belt 260 around pipe 270. Belt 260 can tighten around any diameter pipe that can be engaged by arm 220. No input or adjustment from the operator is required. Once fully in the closed position, motor 232 can be actuated so as to rotate sprocket 233, which moves belt 260 and rotates pipe 270. Locking slot 216 and arm slot 223 constrain barrel end pin 243 to operate as a safety lock preventing arms 220 from opening as pipe 260 is pushed by belt 270 against roller 225. Once arm 220 is locked in the fully closed position, they can only open after barrel end pin 243 is retracted by linear actuator 240.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A pipe spinner comprising:

a body;

an arm pivotally connected to said body and adapted to engage a pipe with a flexible belt;

a drive assembly moveably connected to said body and adapted to engage the flexible belt;

a linear actuator connected to said arm and said drive assembly, wherein said linear actuator is adapted to move said arm to engage the pipe and move said drive assembly to apply tension to the flexible belt; and a locking mechanism adapted to maintain the engagement of said arm and the pipe, wherein said locking mechanism is actuated by said linear actuator.

2. The pipe spinner of claim 1 wherein said locking mechanism further comprises:

a first slot on said arm and adapted to guide a pin attached to one end of said linear actuator; and a second slot on said body and adapted to guide the pin.

3. The pipe spinner of claim 1 further wherein said body encloses said pivoting arm, said drive assembly, and said linear actuator.

4. The pipe spinner of claim 1 further comprising a pin connecting one end of said linear actuator to said drive assembly, wherein said pin is adapted to slide within a slot on said body.

5. The pipe spinner of claim 1 further comprising a spring adapted to urge said pivoting arm to an engaged position with the pipe.

6. The pipe spinner of claim 1 wherein the pipe spinner comprises two pivoting arms and two linear actuators.

7. The pipe spinner of claim 1 wherein the flexible belt is constructed of woven, composite material.

8. A device for rotating a tubular comprising:

a body;

a pivoting arm connected to said body and having a closed position engaging the tubular with a flexible belt and an open position not engaging the tubular;

a moveable drive assembly having a first position not applying tension to the flexible belt and a second position applying tension to the flexible belt;

a linear actuator adapted to move said pivoting arm from the open position to the closed position and said moveable drive from the first position to the second position, wherein said moveable drive is moved to the second position after said pivoting arm is moved to said closed position; and a locking mechanism adapted to maintain said pivoting arm in the closed position, wherein said locking mechanism is actuated by said linear actuator.

9. The device of claim 8 wherein said locking mechanism further comprises:

a first slot on said pivoting arm and adapted to guide a pin attached to one end of said linear actuator; and a second slot on said body and adapted to guide the pin.

10. The device of claim 8 wherein said body encloses said pivoting arm, said drive assembly, and said linear actuator.

11. The device of claim 8 further comprising a pin connecting one end of said linear actuator to said drive assembly, wherein said pin is adapted to slide within a slot on said body.

12. The device of claim 8 further comprising a spring adapted to urge said pivoting arm to the closed position.

13. The device of claim 8 wherein the pipe spinner comprises two pivoting arms and two linear actuators.

14. The device of claim 8 wherein the flexible belt is constructed of woven, composite material.

15. A method for operating a pipe spinner comprising:

pivoting an arm to surround a pipe with a flexible belt;

moving a drive assembly to apply tension to the flexible belt;

activating the drive assembly to drive the belt and rotate the pipe, wherein the arm is pivoted and the drive assembly is moved by a single linear actuator; and engaging a locking mechanism to maintain the position of the arm, wherein the locking mechanism is engaged by the single linear actuator.

16. The method of claim 15 wherein a spring urges the arm to surround the pipe.

17. The method of claim 15 wherein the pipe spinner comprises two pivoting arms and two linear actuators.

* * * * *